US005752296A

United States Patent [19]

Chaput et al.

[11] Patent Number: 5,752,296

[45] Date of Patent: May 19, 1998

[54] SECONDARY RELEASE APPARATUS

[75] Inventors: Dale Chaput, Yorba Linda; Tom Hughes, Ventura; Larry L. McCormick, Camarillo, all of Calif.

[73] Assignee: G & H Technology, Inc., Camarillo, Calif.

[21] Appl. No.: 630,937

[22] Filed: Apr. 5, 1996

[51] Int. Cl.[6] ..... B65D 63/00; H01R 11/00

[52] U.S. Cl. ..... 24/268; 24/279; 24/284; 411/3

[58] Field of Search ..... 24/268, 279, 284, 24/3.4, 597; 411/3, 4, 5

[56] References Cited

U.S. PATENT DOCUMENTS

| | | | |
|---|---|---|---|
| 2,778,085 | 1/1957 | Bernard | 24/268 |
| 2,922,212 | 1/1960 | Textrom | 24/268 |
| 3,027,796 | 4/1962 | Shewmon | 411/3 |
| 4,834,186 | 5/1989 | Ballard | 24/268 |
| 5,092,797 | 3/1992 | Cole et al. | 411/5 |
| 5,415,507 | 5/1995 | Janusz et al. | 411/3 |

*Primary Examiner*—Victor N. Sakran

*Attorney, Agent, or Firm*—George J. Netter

[57] ABSTRACT

A positive release bracket (16) for an object such as an electrical connector part (12) includes first and second semicylindrical shells (18,20) which are releasably held together by plates (36,38). On a separation force applied to the connector exceeding some predetermined maximum, one or both plates (36,38) are withdrawn from engagement with the shells (18,20).

5 Claims, 2 Drawing Sheets

SECONDARY RELEASE APPARATUS

BACKGROUND

1. Background of the Invention

The present invention relates to release apparatus for objects subject to release loading, and, more particularly, such apparatus acting as a secondary and totally reliable means for releasing the object in the event of malfunction of the normal release means.

2. Description of Related Art

There are many circumstances in which an object must be physically released with total reliability for safety purposes. Exemplary of several circumstances from among many are: release of bomb load from an aircraft; separation of parts from a missile at different stages; release of parts from a satellite during launch. In such cases, it could be highly dangerous and perhaps totally destroy the usefulness of the entire equipment if the release of these various parts was not fully completed at the necessary time. Moreover, in many situations there is a requirement that such release be instantly produced upon separation forces between two objects reaching a certain minimum and that the tolerance range of force tolerance be relatively small.

One frequently employed technique for accomplishing rapid and reliable separation of parts has been the use of so-called "explosive bolts" in which a bolt, or other member, is the sole physical interconnection between two objects to be separated. At the time of desired separation, an internal or closely located explosive charge shatters the bolt integrity releasing the objects as desired. Although this system is fully satisfactory in many circumstances, there are other situations in which use of an explosive material or the explosive action itself is unacceptable.

In accordance with another known separation technique, the objects to be separated are related by members of relatively precisely known shear characteristics and of known dimensions preselected such that as separating forces are applied to the parts on some maximum resistance force being exceeded, the members are shattered by the shearing force. Although this technique is suitable for many situations, it has at least one major disadvantage in that the shear characteristics of metals are not as precisely predictable as desired. As a result of this, the actual force to shear two believed identical objects can vary to an objectionable extent.

SUMMARY OF THE INVENTION

Although the present invention may be found useful for many applications, it is particularly described herein and found advantageous for ensuring reliable release of electrical connector parts, such as in a plug and receptacle connector, when a separation force is applied to the parts and exceeds some relatively precise predetermined minimum amount. In particular, one of the connector parts is secured to a first body (e.g., an aircraft) and the second connector part is physically interconnected as well as electrically to a second body which is to be separated from the first body. Upon separation of the two bodies, it is necessary to have the electrical connector parts both physically and electrically separate from one another to prevent damage occurrence.

First and second bracket retainers are unitarily received about the electrical connector parts generally securing the parts together and at the same time enabling the parts to achieve separation when force is applied along the connector axis. However, in the event of bending of the bracket or deformation or breakage of adjacent equipment occurs such that the releasing connector part is unable to move along its normal release path and obstructs against the surrounding bracket, then a separation stress is exerted between the two bracket retainers. These bracket retainers are interconnected to one another by a pair of identical tensile bolts which have the direction of primary tensile stress being applied along the bolt longitudinal axis parallel to the direction of the obstructing release force. These bolts or tensile bars are precisely dimensioned and made of the same material such that upon exceeding some predetermined amount of designed tensile force they will break and physically allow the separation of the bracket parts and thus the trapped electrical connector parts.

BRIEF DESCRIPTION OF THE DRAWING

These and other objects of the present invention will become more readily apparent upon reading the following detailed description and upon reference to the attached drawings, in which.

DESCRIPTION OF A PREFERRED EMBODIMENT

Figure 2:
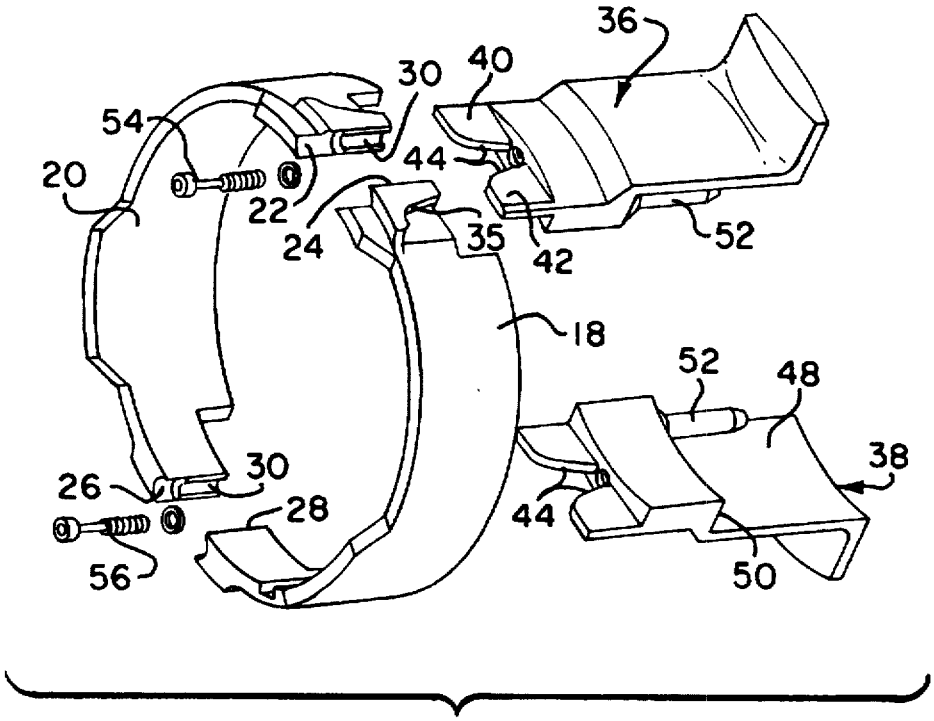
FIG. 2 is a perspective exploded view of the parts of FIG. 1.
Figure 3:
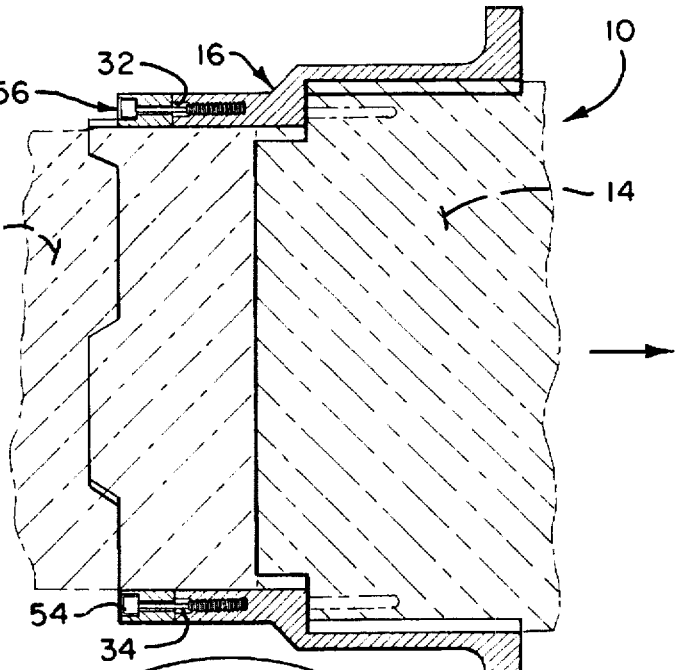
FIG. 3 is a side elevational sectional view taken along the line 3—3 of FIG. 1.

Turning now to the drawing and particularly FIG. 3, there is shown in schematic depiction an electrical connector 10 including a plug 12 and receptacle 14 which are releasably interconnected to provide an electrical circuit between various leads of a cable, for example, through included contacts of conventional construction (not shown). It is seen that the connector parts are in connected mode and secured within a bracket 16 for full electrical connecting operation. Under normal separation conditions, a force applied to connector part 14 in the direction of the arrow will allow the connector part to move out of the bracket 16 to separate from part 12. As will be more particularly described and shown in FIG. 2, if upon attempted separation of the electrical parts the parts hang up or obstruct with the bracket this induces separation stress on the bracket which on exceeding some minimal predetermined value, will cause the entire bracket to be released into four different pieces insuring full release and separation of the electrical connector part 12 from mating relation with part 14.

Figure 4:
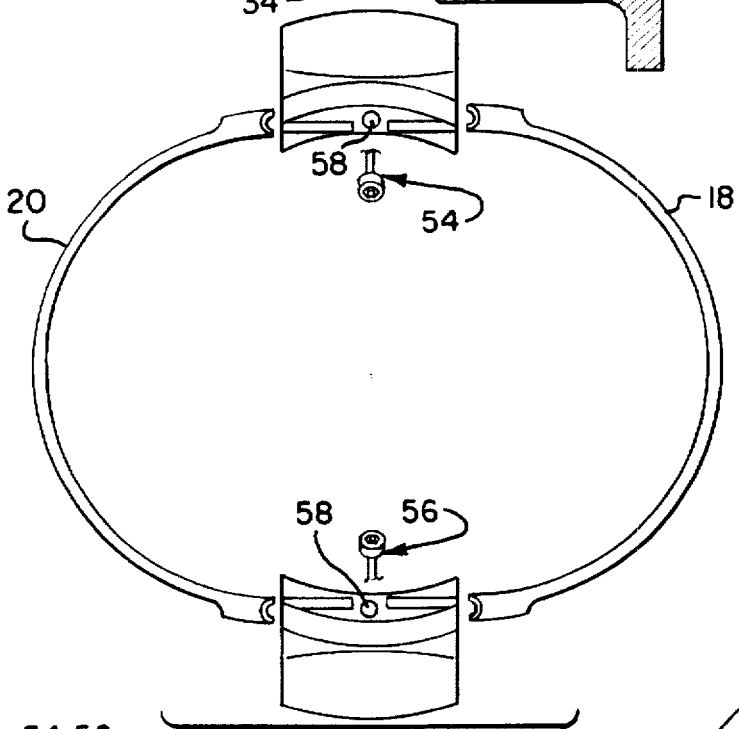
FIG. 4 is an end elevational view of the exploded parts of FIG. 2.

Turning now to FIGS. 2 and 4 simultaneously, the bracket 16 is seen to include first and second semicylindrical shells 18 and 20 configured so as to have paired facing end portions 22, 24 and 26, 28 which can be brought into contact with one another to form overall a unitary cylindrical shell. The shell has a circular internal cross-section of such dimensions as to fit about the electrical connector circumferential periphery and in that way properly locate the connector with respect to associated equipment. The side end portions each include a slotlike shallow opening 30 which, upon members 18 and 20 mating together, forms openings 32 and 34 located, respectively, at each member end portion mating juncture, which openings extend generally parallel to the cylindrical axis of the assembled bracket (FIG. 3). Also, immediately adjacent the shallow opening 30 of each of the members 18 and 20 there is provided a chamber 35 (FIG. 2) in the member which opens out in what is the release direction for the connector (arrow). When the members 18 and 20 are mated, the adjacent chambers 35 are separated by the member wall portions of the opposed end faces 22,24 or 26, 28, as the case may be.

As can be seen best in FIG. 2, the bracket 16 further includes first and second locking plates 36 and 38 which can be of identical construction, and, therefore, only the details of locking plate 36 will be given. The locking plate 36 includes on an end first and second extensions 40 and 42, each of which is dimensioned so as to enable receipt within open-ended chamber 35 on the ends of the members 18 and 20 being brought into contact with one another. Also, the two extensions are unitary with the remainder of the plate 36 and so spaced apart that they can be simultaneously received within a pair of adjacent chambers 35 at either mating junction of members 18 and 20 serving to releasably hold the members together.

More particularly, each extension is constructed with at least one tapered side 44 such that the extensions can be readily inserted into and removed from a chamber 35 without hanging up.

On an inwardly facing surface of each plate 36 and 38, there is provided a cushion block 46 integral with the remainder of the plate, the latter having a curved surface 48 such that when the members 18 and 20 are secured together and the locking plates in position, the curved surface 48 engages the outer surface of the electrical connector holding it in place Each plate has an internal shoulder 50 (FIG. 2) facing away from the members 18 and 20, and from which a pin 52 extends in a direction generally parallel to the axis of the cylinder formed by the members 18 and 20. This pin is received within a corresponding opening (not shown) in an end face of the plug 12 thereby securing the connector part in position.

Figure 1:
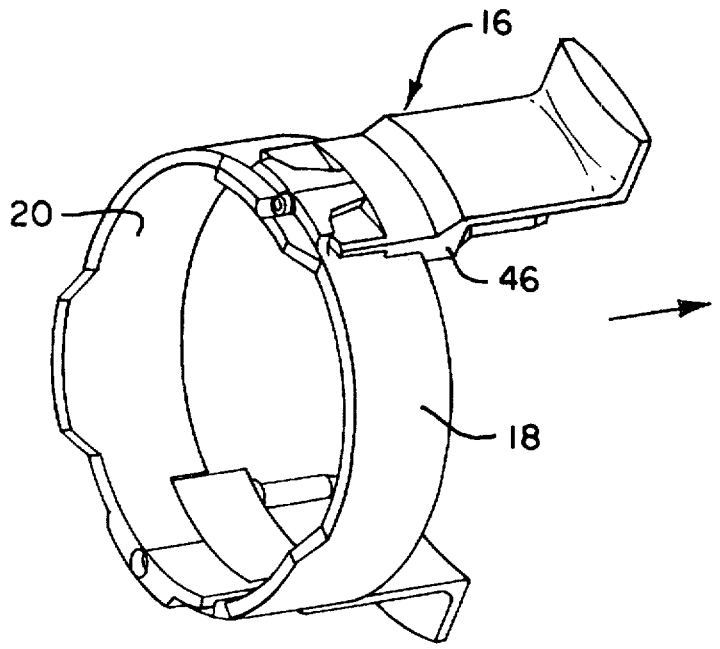
FIG. 1 is a perspective view of an electrical connector being held by a bracket including the frangible release means of the present invention.
Figure 5:
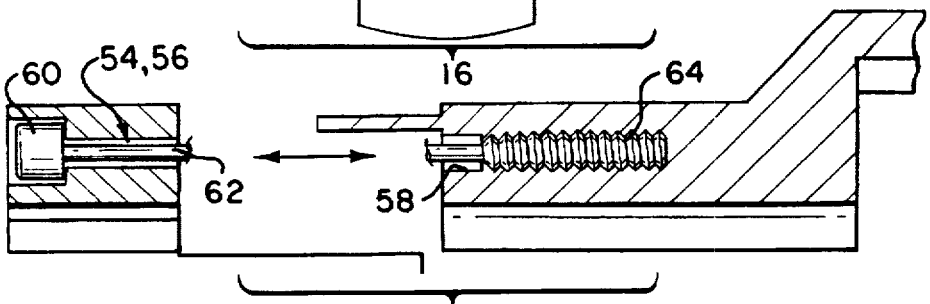
FIG. 5 is an enlarged, partially fragmentary side elevational view showing the frangible bolts of the present invention and associated parts immediately after release.

Turning now to FIGS. 1 and 5, first and second tensile rods 54 and 56 are received, respectively, through the openings 32 and 34 and are threaded within an opening 58 in the outer end of the locking plates between the extensions. Each of the tensile rods includes an enlarged head 60 which prevents its passing through an opening 32 or 34 so that when the ends of the rods are threaded within the openings 58 this tightly secures and locks the members 18 and 20 to one another and also to the locking plates.

For the ensuing detailed description of a preferred tensile rod reference is made to FIGS. 3 and 5. Each tensile rod is seen to include an enlarged head 60 and, extending from the head, a length of an unthreaded shaft 62 of uniform cross-sectional dimensions, and terminating in an enlarged threaded end portion 64. Specifically, the unthreaded shaft 62 is dimensioned and made of a material so as to have a precise predetermined frangibility point when exposed to a separation force directed along the longitudinal axis indicated by the arrows in FIG. 5.

With respect to use of the described apparatus, assume initially that the electrical connector parts are mated, that the receptacle 14 is affixed to a first body 66 (e.g., an aircraft) and that the primary release means for the connector has been activated, but for some reason the connector plug 12 has not been freed from the bracket and cannot freely release in the direction shown by the arrow in FIGS. 1 and 3. The result of the failure of the primary release means induces tensile stress on the bracket 16 and thus in the rods 54 and 56, which on exceeding the predetermined design tensile stress maximum causes the rods to break. On breakage, the tensile rods release the locking plates from the shell members which, in turn, allows the members to separate and positively release the plug connector part 12.

Although the invention has been described in connection with a preferred embodiment, it is to be understood that those skilled in the appertaining arts may make changes that come within the spirit of the invention as disclosed and within the ambit of the appended claims.

What is claimed is:

1. Positive release assembly comprising:

first and second joined objects releasable from one another upon application of a force in a first direction exceeding a first value;

bracket means secured to the first object including first and second parts clampingly received onto the first object, said bracket means parts being released from one another on the tensile bar means separating into more than one piece;

plate means secured to the second object and including first and second plates which fittingly lock the bracket means together at the common contact surfaces, respectively; and tensile bar means interconnecting the bracket and place means including first and second tensile bars respectively interconnecting each plate with both bracket means parts, separation of the two tensile bars each into more than one piece physically releasing the first and second bracket means parts and plates from each other.

2. Apparatus as in claim 1, in which there is provided a chamber formed in each part immediately adjacent each contacting surface; and paired extensions on the plate means received within the chambers adjacent each contacting surface to releasably lock the said parts together.

3. Apparatus as in claim 1, in which the tensile bar means is constructed of corrosion resistant material and is fractured in tension on separation of the connector parts obstructing with the plate means.

4. Apparatus as in claim 3, in which the tensile bar means is constructed of stainless steel.

5. Positive release assembly as in claim 1, in which the tensile bar means includes first and second opposite ends and an intermediate portion of reduced cross-section which determines the tensile stress at which the tensile bar means separates into more than one piece.

* * * * *